US007320631B1

(12) United States Patent
Distefano et al.

(10) Patent No.: US 7,320,631 B1
(45) Date of Patent: Jan. 22, 2008

(54) NAUTICAL LIGHT EMITTING DIODE ("LED") SAFETY CHANNEL MARKER

(76) Inventors: Matthew Distefano, 3113 Albatross Rd., Apt. B, Delray Beach, FL (US) 33444; Charles Taylor, 14531 Wood Pine Dr., Delray Beach, FL (US) 33445

( * ) Notice: Subject to any disclaimer, the term of this patent is extended or adjusted under 35 U.S.C. 154(b) by 0 days.

(21) Appl. No.: 11/496,664

(22) Filed: Jul. 31, 2006

(51) Int. Cl.
*B63B 22/16* (2006.01)

(52) U.S. Cl. ..... 441/16; 362/477

(58) Field of Classification Search ..... 441/1, 441/6, 11, 13, 16, 17, 18; 362/477, 555; 40/541

See application file for complete search history.

(56) References Cited

U.S. PATENT DOCUMENTS 3,628,006 A * 12/1971 Sprunt et al. ..... 362/363
4,344,110 A * 8/1982 Ruediger ..... 362/560
5,066,338 A * 11/1991 Meyers ..... 136/244
5,362,267 A * 11/1994 Forrest ..... 441/16
7,217,006 B2 * 5/2007 Trenchard et al. ..... 362/249

* cited by examiner

*Primary Examiner*—Ed Swinehart
(74) *Attorney, Agent, or Firm*—Gold & Rizvi, P.A.; H. John Rizvi; Glenn E. Gold

(57) ABSTRACT

A nautical light emitting diode ("LED") safety channel marker that is cylindrical in shape, capable of displaying lighted oceanic regulation symbols on either side, and that at night illuminates the panels that display a red triangle and a green square through the use of LEDs that surround the perimeter of the square and triangle in order to more effectively prevent boats from colliding with the markers during the darkness hours.

10 Claims, 4 Drawing Sheets

NAUTICAL LIGHT EMITTING DIODE ("LED") SAFETY CHANNEL MARKER

BACKGROUND OF THE INVENTION

1. Field of the Invention

This invention relates generally to the field of channel markers and buoys, specifically to a solar powered channel marker that allows for the illumination of the signs located on the markers via light emitting diodes ("LEDs") during the darkness hours to prevent water going vessels from colliding with the markers.

2. Description of the Prior Art

Aids to navigation are commonly known as buoys or channel markers. These markers provide the boating public with a sense of direction while on the water. Generally speaking, green markers are kept to the right when leaving a harbor and red markers are kept the right when returning to the harbor. Typically, these markers are not visible at night without the use of reflective tape or the addition of a light bulb affixed atop the marker.

In order to increase safety, it is advisable that channel markers be sufficiently lit at night, ergo with more illumination that provided by the mere use of reflective tape or a light bulb affixed to the top of the marker or signs. In order to increase energy efficiency, it is also desirable that the power source to light these markers at night be renewable and not subject to an exhaustion of power, thereby requiring periodic replacement. Hence, a need exists for a solar-powered, night-time illuminated channel marker that clearly and boldly signals to the vessels in the channel the respective green and red sides of the marker in order to prevent the collision of water-going vessels with channel markers while navigating at night.

SUMMARY OF THE INVENTION

In the preferred embodiment of the invention, a channel marker is disclosed that illuminates at night through the employment of light emitting diodes ("LEDs"), thereby preventing boats from running into the markers during the evening hours. The marker is cylindrical in shape and attaches to channel marking posts found in harbors or other waterways. The marker is capable of displaying lighted oceanic regulation symbols on either side, with the illumination occurring directly on the panels on the sides of the channel marker indicating red or green around the perimeter of the square or triangle. The solar panel protrudes from the top of the cylinder through the side and collects solar energy during the day.

At night, the LED lights turn on, activated by the darkness outside as determined by a photocell. The photocell powers on the LEDs at dark, thereby illuminating the marker, and powers back down during the daylight. Additionally, stainless steel members can protrude from the cap enclosing the cylinder to keep birds from meddling with the marker. A shelf is placed inside of the cylinder whereupon the battery and internal portions of the solar energy collecting means rest in a segregated space that is separate from where the marker attaches to the posts in the harbor.

The solar panel is always in a sun-collecting position and is rotatable. The solar panel can be rotated to provide access to the internal components of the marker for repairs, battery replacement and the like. The cap is removed only to get at these internal components, at which time the solar panel needs to be rotated in order to grant access therein.

The channel marker contains a solar charge controller located inside of the body that turns off the solar panel when the battery is fully charged so that it does not overcharge or damage the battery.

The principal object of the invention is to provide a means for illuminating channel markers with the illumination taking place during darkness hours through the use of light emitting diodes placed directly on the panels that indicate red or green in the shape of a square or a triangle.

It is a further object of the invention that the illumination of the channel markers be solar powered.

It is a further object of the invention to prevent birds from meddling with the solar energy collecting means of the channel marker.

Numerous other advantages and features of and various means for practicing the invention will become apparent from the detailed description of the preferred embodiment of the invention, from the claims, and from the accompanying drawings, in which like numerals are used to designate like parts shown in different figures.

DETAILED DESCRIPTION OF A PREFERRED EMBODIMENT

Figure 1B:
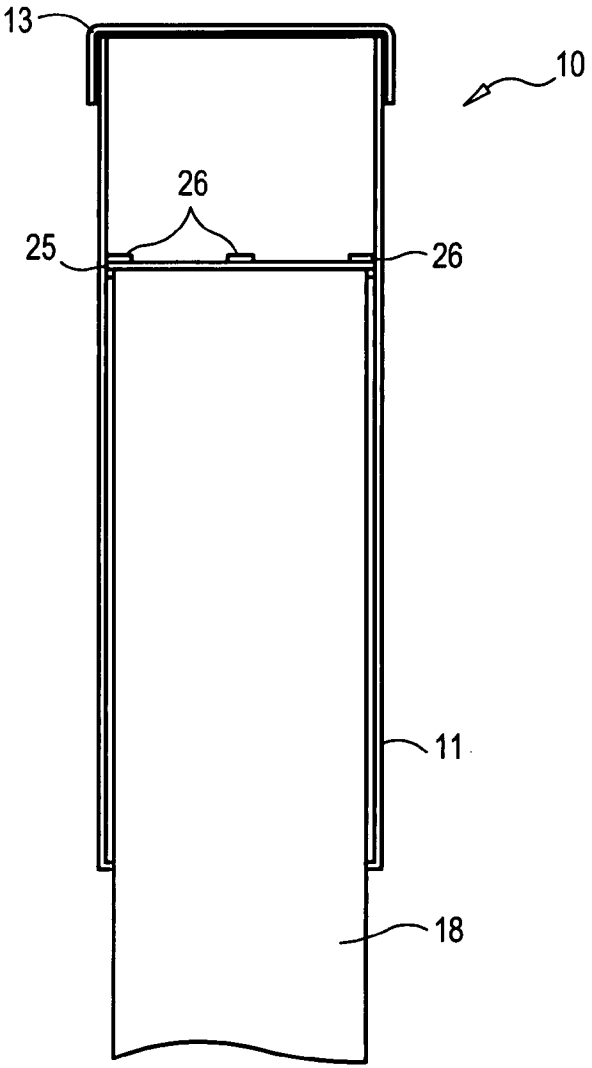
FIG. 1B illustrates a side view of a partial depiction of the invention with the reflective panels facing sideways.
Figure 1A:
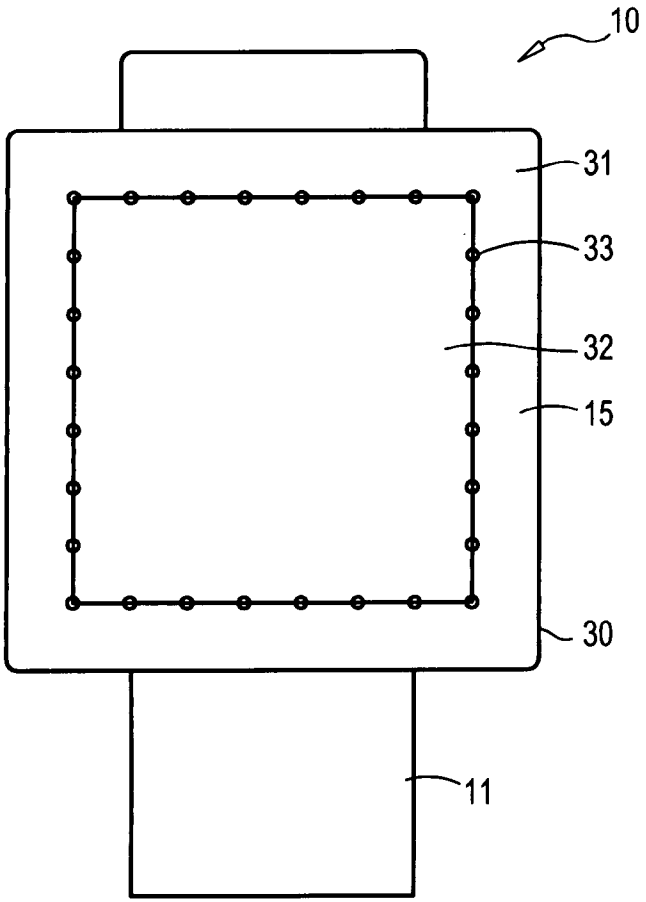
FIG. 1A illustrates a side view of a partial depiction of the invention with the reflective panels facing forward.
Figure 2B:
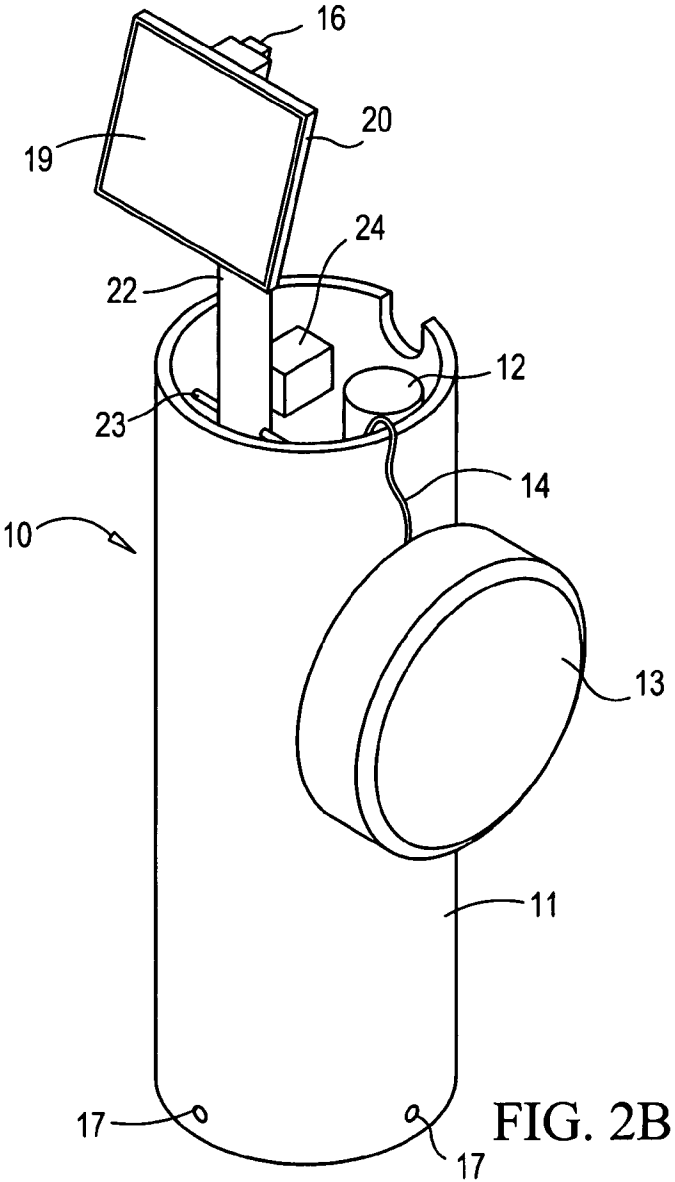
FIG. 2B illustrates a top perspective view of a partial depiction of the invention demonstrating how the solar panel is rotatable.
Figure 2A:
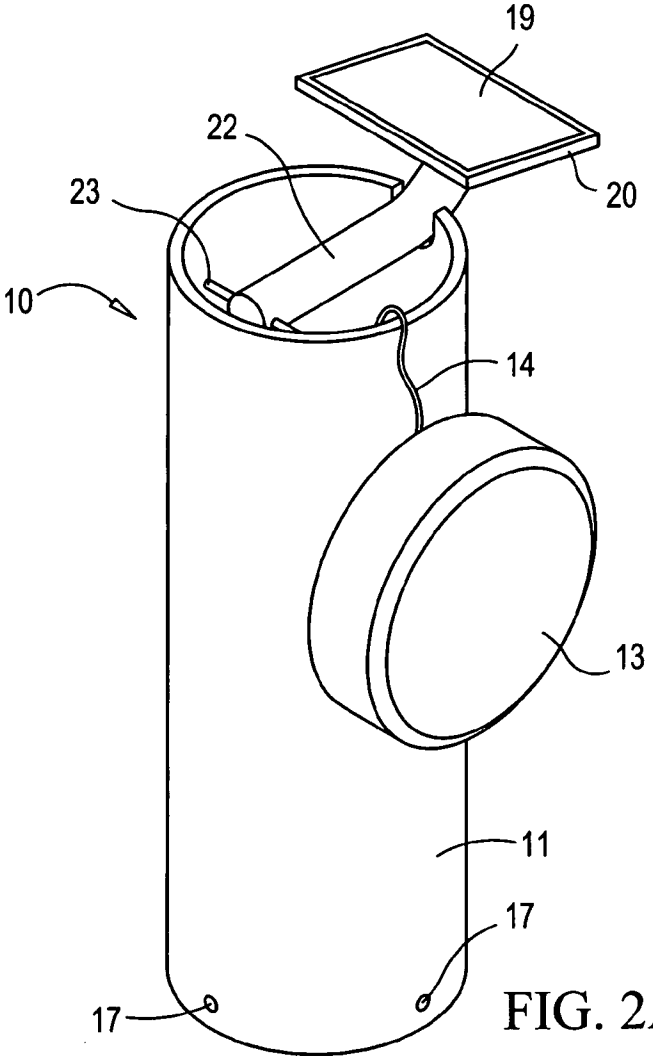
FIG. 2A illustrates a top perspective view of a partial depiction of the invention demonstrating how the solar panel is exposed outside of the cylinder and facing upward.
Figure 3B:
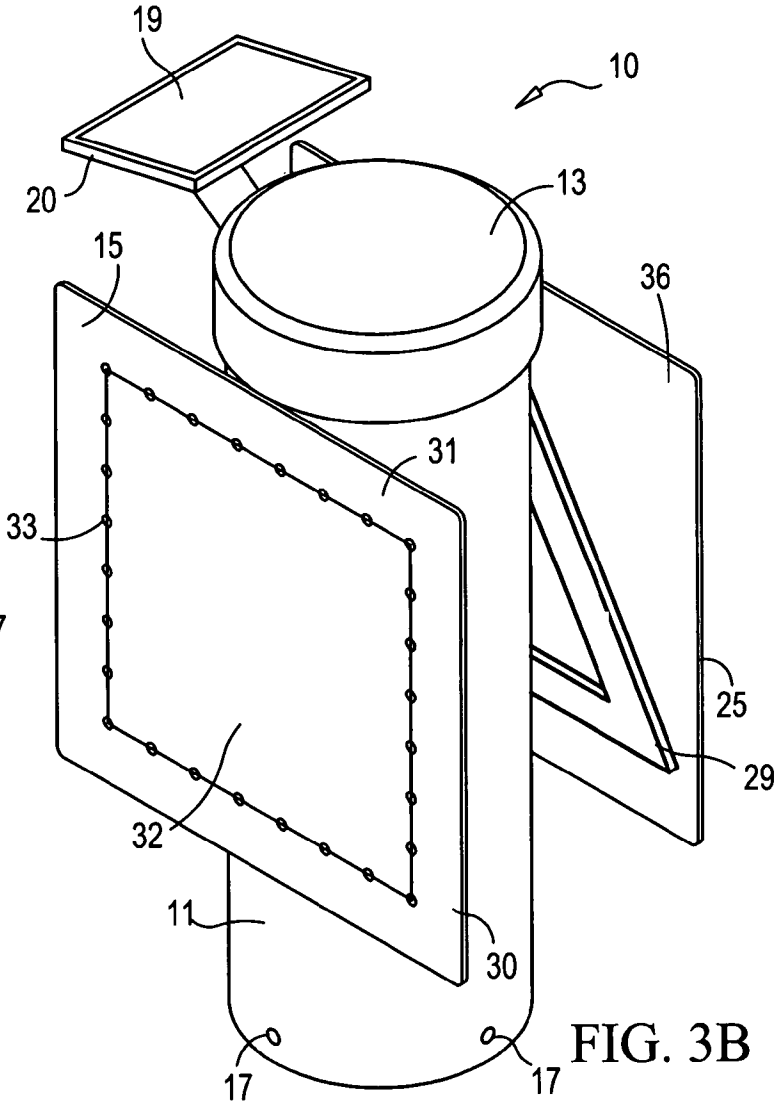
FIG. 3B illustrates a top perspective view of the invention without the bird repellent means shown.
Figure 3A:
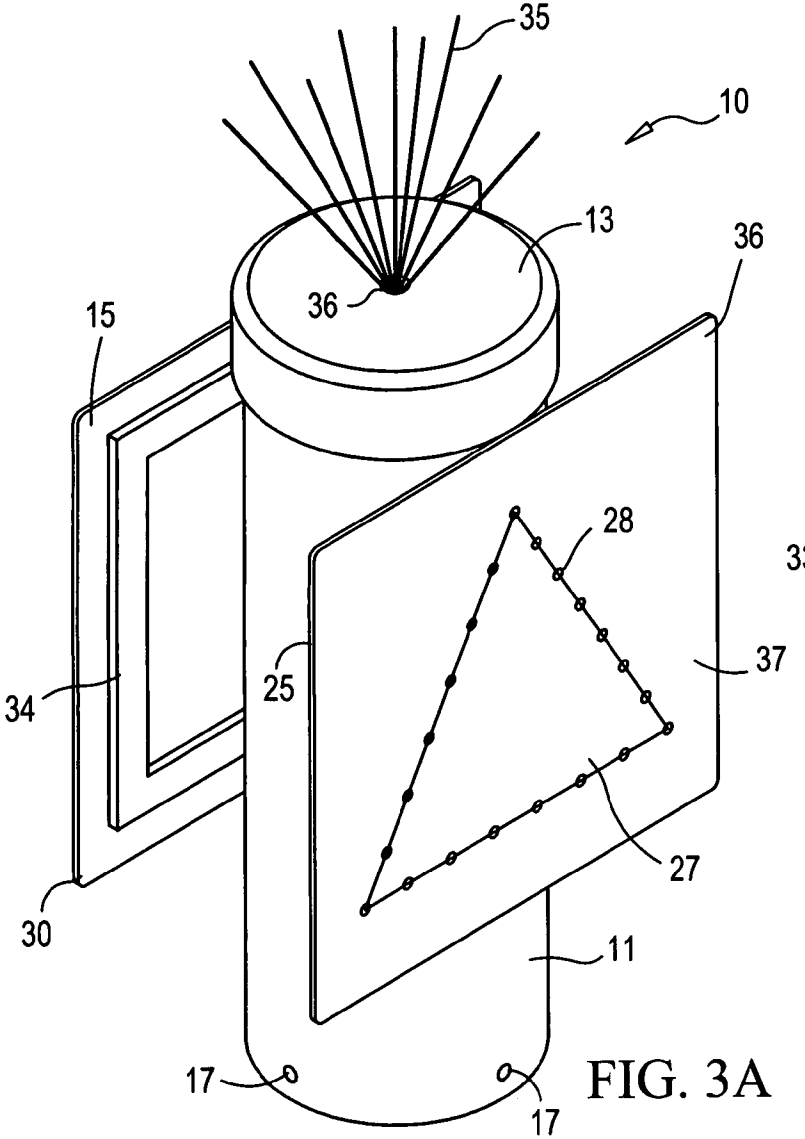
FIG. 3A illustrates a top perspective view of the entire invention with the bird repellent means protruding through the top without the solar panel shown.
Figure 4:
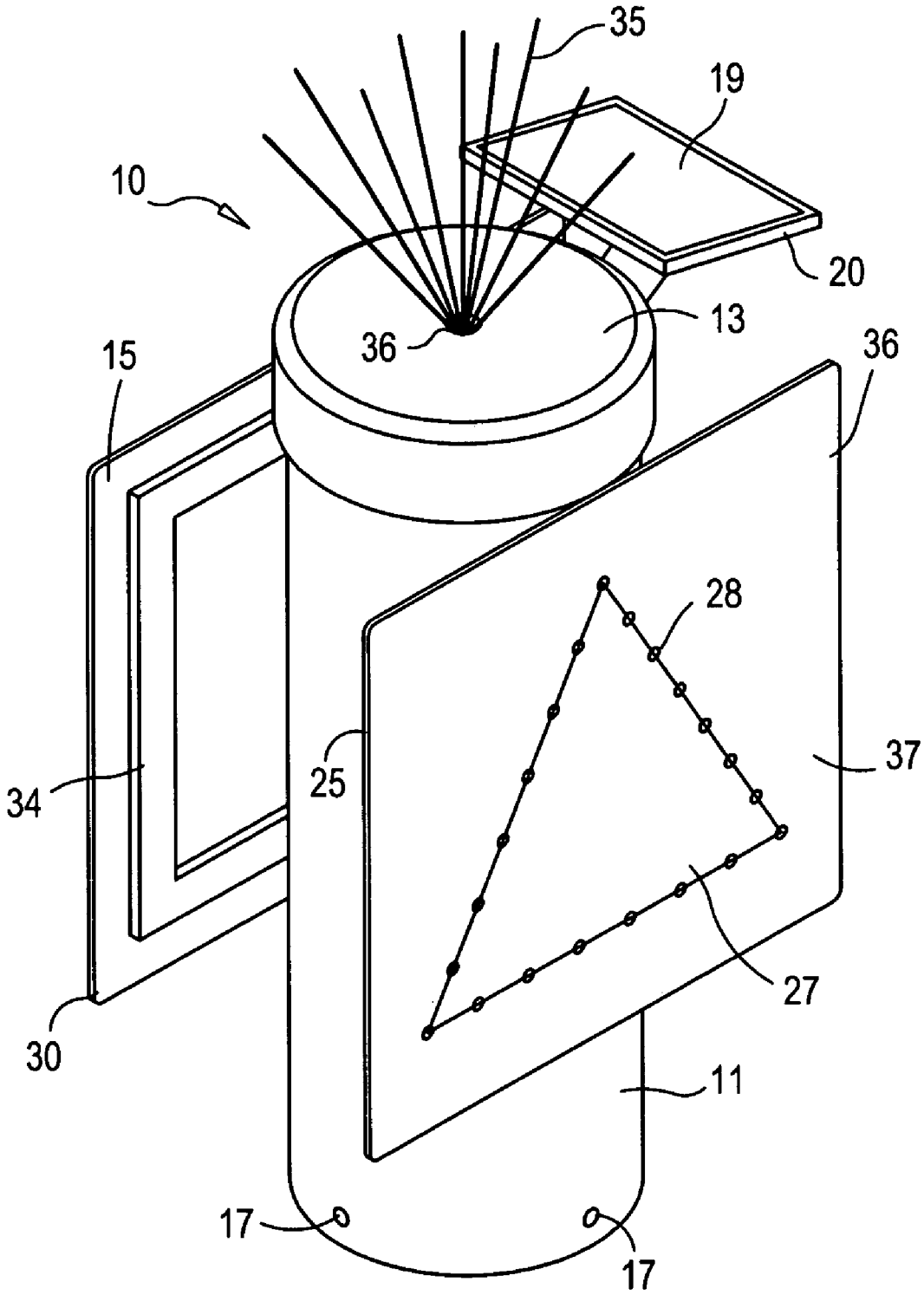
FIG. 4 illustrates a top perspective view of the entire invention with the solar panel in collecting position and the bird repellent means demonstrated.

FIGS. 1A-4 illustrate a preferred embodiment of the invention, which is a solar powered channel marker 10. The marker 10 is constructed to contain a main body portion 11 that is substantially hollow and cylindrical in shape and preferably made of PVC piping, typically with 3'12" dimensions, #40 round. The marker 10 also has a capping means, typically a 12" PVC pipe cap cover lid 13 that encloses the marker 10.

The invention includes a solar energy collecting means that allows for the collection of solar energy during the daylight hours. Stored solar energy collected during the daylight hours allows for the illumination of standard lighted oceanic regulation symbols on either side of the main body portion 11 during darkness hours.

The solar energy collecting means is further composed of a solar panel 19 that is typically 5 watts and 13"×11½", to collect the solar energy; a mounting plate 20 upon which the solar panel is mounted, typically a ⅛"×13"×11½" aluminum mounting plate; a swivel base (not shown) that is attached to the underside of the mounting plate 20 and positioned substantially in the center of the solar panel 19; a long pipe 22 attached to the swivel base, typically a 1¾"×20" long powder-coated pipe; a hinge bracket 23 that is attached to the opposite end of the long pipe 22 from the end attached to the swivel base, thereby allowing for the moving of the solar panel 19 into and out of the main body portion 11 when access to the inner port of the main body portion 11 is need for repairs, battery changes, etc.; and a charge controlling box 24 located inside of the main body portion 11. The charge controller 24 located inside the main body portion 11 turns off the solar panel 19 when the battery 12 is fully charged so that it does not overcharge or damage the battery 12.

To keep the capping means 13 connected to the main body portion 11 when the marker 10 is open and the cap 13 removed, a stainless steel wire 14 with looped ends connects the inside of the capping means 13 to the inside of the main body portion 11. The cable is typically ⅛"×19" long.

Portions of the solar energy collecting means and a 12 volt battery cell 12 are kept in place inside of the main body portion 11 by resting upon a shelf 25 that is held in place by a plurality of blocks 26. The shelf 25 is ½"×11¾" round shelf, typically made of starbord plastic wood. Preferably, the shelf 25 is held in place by 6½"×2"×2" blocks 26, with four of the blocks 26 placed on top of the shelf 25 and two on the bottom. As with the shelf 25, the blocks are typically made of starbord plastic wood.

Two panels 36, 15 are attached to the outside of the main body portion 11 and positioned opposite from each other. One panel 36 displays a standard illuminated triangle 27 whereas the other displays a standard illuminated square 32.

The panel 36 containing the triangle 27 is composed of a base portion 25 that is typically composed of a ⅛" 24"×24" aluminum sheet with rounded corners. Mounted on the base portion 25 is a 24"×24" white high reflective film sheet 37 that is mounted to the front of the base portion 25. A 20"×20"×20" red high reflective film fabricated into the shape of a triangle 27 is mounted to the base portion 25 inside of the area covered by the white reflective film 26. A plurality of 5 mm red LED lights 28 surround the perimeter of the triangle 27 and are mounted to the base portion 25 through a mounting means (not shown) such as a series of 5/16" rubber wire grommets. Aluminum covers 29 are attached to the back of the base portion 25 to seal the wiring of the LED lights 28. Typically, three 2"×1"×20" aluminum covers are used to seal the wiring on the back of the triangle 27.

The panel 15 containing the square 32 is composed of a base portion 30 that is typically composed of a ⅛" 24"×24" aluminum sheet with rounded corners. Mounted on the base portion 30 is a 24"×24" white high reflective film sheet 31 that is mounted to the front of the base portion 30. A 16"×16" green high reflective film fabricated into the shape of a square 32 is mounted to the base portion 30 inside of the area covered by the white reflective film 31. A plurality of 5 mm green LED lights 33 surround the perimeter of the square 32 and are mounted to the base portion 30 through a mounting means (not shown) such as a series of 5/16" rubber wire grommets. Aluminum covers 34 are attached to the back of the base portion 30 to seal the wiring of the LED lights 33. Typically, four 2"×1"×18" aluminum covers are used to seal the wiring on the back of the square 32.

Located on the bottom perimeter of the main body portion 11 are a series of apertures 17 for attachment to posts 18 found in the channel. The main body portion 11 is attached to post 18 through the use of a series of stainless steel nuts and bolts (not shown) that attach through the apertures 17 to the post 18.

To avoid disturbance by birds, a plurality of thin, stainless steel members 35 protrude from an aperture 38 located in the center of the capping means 13, with the members 35 being sufficiently long so as to repel any birds interested in meddling with the marker 10 or the inner workings thereof.

The illustrations and examples provided herein are for explanatory purposes and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

What is claimed is:

1. A solar powered channel marker comprising a main body portion, substantially hollow and cylindrical in shape;

means for collecting solar energy;

a capping means to enclose said main body portion;

means connecting said capping means to said main body portion to keep said capping means secured to said main body portion when said capping means is detached from said main body portion;

one panel attached to the outside of said main body portion that displays a standard illuminated triangle through the use of red light emitting diodes surrounding the perimeter of said triangle;

one panel attached to the outside of said main body portion on the opposite side of the side where said panel displaying said standard illuminated triangle that displays a standard illuminated square through the use of green light emitting diodes surrounding the perimeter of said square;

a photocell that powers said light emitting diodes based upon how dark it is outside;

attachment means located on the bottom perimeter of said main body portion for attachment to posts located in a channel, said attachment means being a plurality of apertures that attach to said posts through a series of nuts and bolts.

2. A solar powered channel marker as described in claim 1 wherein said means for collecting solar energy further comprises a solar panel;

a battery cell;

a mounting plate upon which said solar panel is mounted;

a swivel base attached to the underside of said mounting plate, positioned substantially in the center of said mounting plate;

a long pipe attached to said swivel base;

a hinge bracket attached to the opposite end of said long pipe than the end attached to said swivel base allowing for the moving into and out of said main body portion of said solar panel;

a charge controlling box located inside of said main body portion that turns off said solar panel when said battery is fully charged.

3. A solar powered channel marker as described in claim 2 wherein said battery is a 12 volt deep cell battery.

4. A solar powered channel marker as described in claim 2 wherein said battery rests inside of said main body portion on a shelf that is held in place by a plurality of blocks.

5. A solar powered channel marker as described in claim 1 wherein said main body portion is made of PVC tubing.

6. A solar powered channel marker as described in claim 1 wherein said capping means is a PVC pipe cap cover.

7. A solar powered channel marker as described in claim 1 wherein said connecting means connecting said capping means is a stainless steel cable with looped ends.

8. A solar powered channel marker as described in claim 1 wherein said panel illuminating a standard triangle further comprises a base portion made of aluminum sheets with rounded corners;

a white reflective film backing sheet mounted to the front of said base portion;

a red high reflective film triangle mounted to said base portion, positioned inside of said white reflective film;

a plurality of red light emitting diodes surrounding the perimeter of said triangle;

mounting means such as rubber wire grommets to mount said plurality of red LED lights to said base portion;

aluminum covers attached to the back of said base portion to seal the wiring of said LED lights.

9. A solar powered channel marker as described in claim 1 wherein said panel illuminating a standard square further comprises a base portion made of aluminum sheets with rounded corners;

a white reflective film backing sheet mounted to said base portion;

a green high reflective film square mounted to said base portion, positioned inside of said white reflective film;

a plurality of green light emitting diodes surrounding the perimeter of said square;

mounting means such as rubber wire grommets to mount said plurality of green LED lights to said base portion;

aluminum covers attached to the back of said base portion to seal the wiring of said LED lights.

10. A solar powered channel marker as described in claim 1 wherein a plurality of thin, stainless steel members protrude from an aperture located in the center of said capping means, said members being sufficiently long to repel birds from resting on said solar powered channel marker.

* * * * *